US011591208B2

(12) United States Patent
Marshall

(10) Patent No.: US 11,591,208 B2
(45) Date of Patent: Feb. 28, 2023

(54) SADDLE STIRRUP ADJUSTABLE STRAP D-RING

(71) Applicant: M. Dianne Marshall, Salem, KY (US)

(72) Inventor: M. Dianne Marshall, Salem, KY (US)

(73) Assignee: Sports Saddle, Inc., Salem, KY (US)

( * ) Notice: Subject to any disclaimer, the term of this patent is extended or adjusted under 35 U.S.C. 154(b) by 60 days.

(21) Appl. No.: 16/808,475

(22) Filed: Mar. 4, 2020

(65) Prior Publication Data

US 2020/0283284 A1 Sep. 10, 2020

Related U.S. Application Data

(60) Provisional application No. 62/813,350, filed on Mar. 4, 2019.

(51) Int. Cl.
*B68C 1/16* (2006.01)
*B68C 3/00* (2006.01)
*B68C 3/02* (2006.01)

(52) U.S. Cl.
CPC ..... *B68C 1/16* (2013.01); *B68C 3/02* (2013.01); *B68C 2003/0008* (2013.01)

(58) Field of Classification Search
None
See application file for complete search history.

(56) References Cited

U.S. PATENT DOCUMENTS 100,565 A * 3/1870 Snedden ..... B68C 1/16 54/23
327,165 A * 9/1885 Haslam ..... B68C 1/16 54/46.2
740,932 A * 10/1903 Schuett ..... B68C 1/16 54/46.1
778,090 A * 12/1904 Wellmann ..... B68C 1/16 54/46.1
809,179 A * 1/1906 Fontaine ..... B68C 1/16 54/46.1
918,212 A * 4/1909 Solatinow ..... B68C 1/16 54/46.1

(Continued)

FOREIGN PATENT DOCUMENTS

DE 202014002916 U1 * 6/2014 ..... B68C 1/16
GB 2443882 A * 5/2008 ..... B68C 1/02

*Primary Examiner* — Jessica B Wong

(74) *Attorney, Agent, or Firm* — Carrithers Law Office, PLLC

(57) ABSTRACT

A modified saddle D-ring having a loop of a varying radius for supporting a stirrup strap on a saddle. The stirrup supporting strap is looped around a lower span portion of the D-ring which has an upper span portion anchored to the saddle. The lower span has an upper surface that abuts against the saddle supporting strap and such upper surface includes first and second contiguous portions disposed at a preselected angle to one another with the length being greater than the width of the stirrup supporting strap. The D-ring includes an elongated curved loop extending forward at a varying radius depicting a parabolic curve. The elongated D-ring allows limited pivotal forward movement of the stirrup with respect to the saddle. One or more "T" shaped projections may extend upward from one a selected position at the bottom of the D-ring for adjusting and holding the D-ring in position.

5 Claims, 8 Drawing Sheets

(56) References Cited

U.S. PATENT DOCUMENTS

| | | | | | |
|---|---|---|---|---|---|
| 1,040,316 | A | * | 10/1912 | Harrington | B68C 1/16 54/46.1 |
| 1,072,958 | A | * | 9/1913 | Kerr | B68C 1/16 296/144 |
| 1,371,020 | A | | 3/1921 | Connolly | |
| 2,091,897 | A | | 8/1937 | Vance | |
| 2,418,103 | A | * | 3/1947 | Wells | B68C 1/16 54/47 |
| 2,474,953 | A | * | 7/1949 | Mock | B68C 1/02 54/46.2 |
| 2,525,849 | A | * | 10/1950 | Allison | B68C 1/16 54/46.2 |
| 2,830,420 | A | | 4/1958 | Smith | |
| 3,978,644 | A | | 9/1976 | Hillman | |
| 4,782,649 | A | | 11/1988 | Zubrod | |
| 5,107,660 | A | | 4/1992 | Mommeja | |
| 5,355,660 | A | * | 10/1994 | Shimon | B68C 1/14 54/46.2 |
| 6,035,616 | A | | 3/2000 | Pickett | |
| 7,249,446 | B1 | | 7/2007 | Hapner | |
| 9,266,712 | B2 | | 2/2016 | Grimes | |
| 9,718,667 | B2 | | 8/2017 | Elliott | |
| 2001/0009092 | A1 | | 7/2001 | Gronberg | |
| 2006/0248863 | A1 | | 11/2006 | Gorman | |
| 2012/0260614 | A1 | | 10/2012 | Grimes | |
| 2015/0266716 | A1 | | 9/2015 | Elliott | |
| 2017/0197819 | A1 | | 7/2017 | Powell | |
| 2017/0267515 | A1 | | 9/2017 | Brisbin | |

* cited by examiner

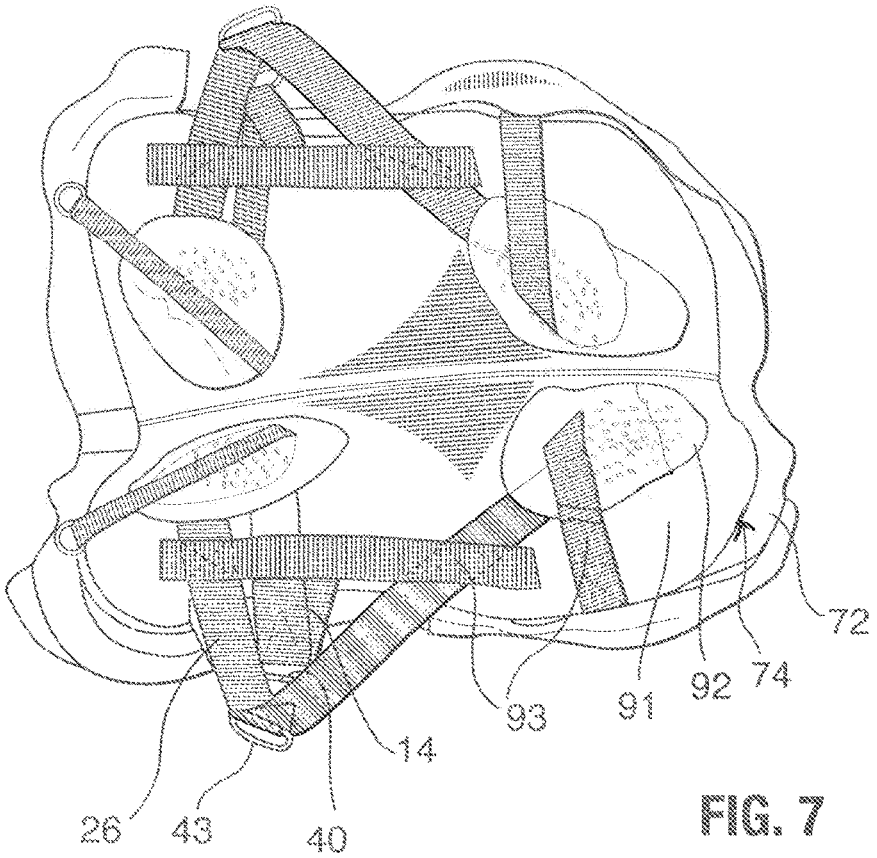
FIG. 7
FIG. 8
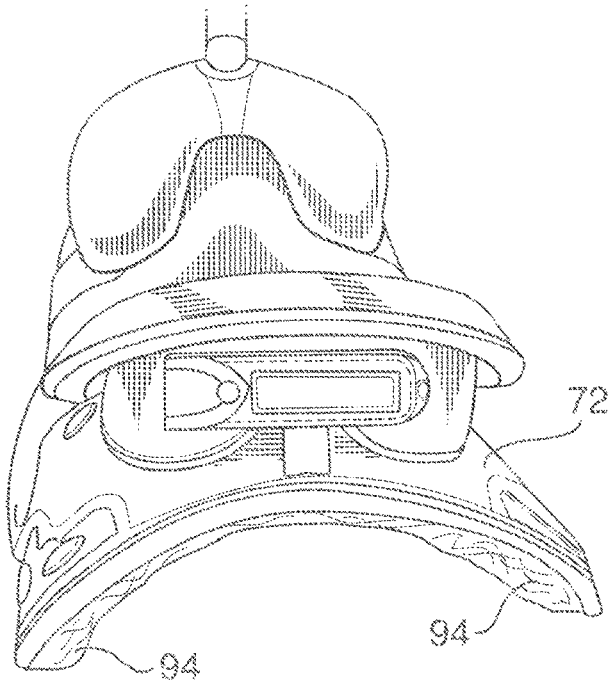

SADDLE STIRRUP ADJUSTABLE STRAP D-RING

FIELD OF INVENTION

The present invention relates generally to riding saddles and more particularly to a modified elongated D-ring with a loop having a front portion of varying radi for providing limited pivotal movement of the stirrup and stirrup strap with respect to the saddle.

BACKGROUND OF INVENTION

A conventional western type saddle includes a framework or tree defining the shape of the saddle whereby the typical saddle tree is ridged and consists of spaced apart parallel bars connecting a horn, pommel and cantle with the seat disposed there between resting upon the bars. The tree is composed of wood, metal, plastic, fibreglass, synthetic material or combinations thereof. * The tree is usually covered with leather on all visible parts of the saddle. Trees differ in width of the gullet and bars, pitch of the bars (steep to flat), and length of the bars. The tree also influence the shape of the pommel and cantle on the seat on the saddle. The bars form the primary loading surface of the saddle and are designed for a particular type of horse. For instance a wider gullet sits lower on the horse while a narrow gullet sits higher is designed to fit a horse with higher withers. The seat may have foam rubber or other cushioning materials disposed between the tree and top layer of leather to provide additional comfort to the rider. Moreover the leather or foam padding may be used to alter the contours of the seat. Typically a breathable material such as sheepskin is placed on the underside of the saddle covering both the tree and the underside of the skirts. The cinch rings are attached to the tree as part of the rigging which refers to the arrangement of rings and plate hardware connect the girthing system for holding the saddle on the horse. The front rigging consists of metal cinch rings on each side of the saddle to which a long wide strap called a latigo is attached for holding the front cinch going around the heart girth of the horse just behind the elbows. The back cinch is placed around the wides part of the horse's barrel attached to the saddle by a second set of cinch rings. Latigos run through the cinch ring and back to the rigging. The cinch may be secured by a knot or buckle and hole arrangement. Leather or a nylon web is used for the latigo. A back cinch may be used and typically consists of heavy leather billet on each side of the saddle that buckles just tight enough to touch the underside of the horse. A belly strap may be used at the belly midline to prevent the back cinch from moving too far back.

Stirrup rigging is set or positioned for various degrees of comfort, flexibility and security depending on the rider's needs. The normal position for stirrup rigging is to set the front edge of the strap connecting the bottom ring, within approximately 1 inch forward of behind the centre of the pommel. The strap connecting the top ring is ¾ inch back from the bottom rings strap. The normal setting places approximately 60% of the rider's weight toward the rear and moves the weight of the rider toward the rear when they exert pressure on the stirrups providing a more secure seat position but doesn't allow the rider to easily stand in the stirrups. Setting the stirrup rigging back ½ to 1 inch from the cinch ring shifts more of the rider's weight more forward a the rigging is set farther back. The rider gains a mechanical advantage from where they push up from the feet beneath the rider's centre of gravity.

Modern stirrups come in a wide variety of styles, sizes and materials and are attached to most saddles by means of adjustable stirrup leathers, which can be altered in length to fit both the size of the rider and the need to remain over the horse's optimal centre of balance. Because a rider must be able to move his or her legs while riding, stirrups cannot be attached on the body of the saddle itself, but rather must be attached in a manner that allows the rider's leg a full range of motion. Therefore, stirrups are attached to a saddle by means of adjustable straps, called stirrup leathers. Depending on the design of a saddle, stirrup leathers may be attached to a "stirrup bar," a small forged steel bar embedded into the saddle tree, or may be wrapped around the bars of the tree itself. Because different riders are of different heights, and stirrups also may need to be adjusted up or down to accommodate different types of activity, stirrups leathers have buckles and holes that allow length to be adjusted. Conventional saddles have each stirrup supported by a strap that depends downwardly from a "D shaped ring" called a "D-ring" that takes the place of a stirrup bar that is securely anchored to the saddle.

Stirrup straps can be worn so that the smooth side of the leather faces the wearing surface, as the smooth side wears less quickly than the rough side. There are also alternatives to leather, including nylon, plastic covered nylon or leather over a nylon reinforced core. As the rider's whole weight must be carried at one side when mounting, one stirrup strap often becomes stretched longer than the other, usually the left one, because most mounting occurs on that side. While a simple adjustment of the leather can even up the stirrups. On a western saddle, with a heavier, permanently installed fender and stirrup straps that are more difficult to be switched, stretching is slower and less extreme, though it also occurs in this type of saddle. Any unevenness in the leathers can be managed by adjusting the stirrup length, and if necessary, by adding extra holes in the leathers to allow them to be buckled at an intermediate point between the existing prepunched holes provided by the saddle manufacturer.

Moreover, the stirrup of western saddle is difficult to remove or replace and the same stirrups usually are kept on for the life of the saddle. One type of arrangement utilizes the stirrup strap looping under a rod and a keeper. A strap with a buckle that wraps around the front and back of the stirrup leather, keeps the stirrup in place. Western stirrups are generally made of leather-covered wood, others of steel, aluminum, or even very strong fiber-reinforced plastic.

The D-rings are located between a lower pad portion of the saddle that rests on the horses back and an upper layer upon which the rider sits. The upper layer includes a flexible flap that overlies the D-ring and strap that attaches the same to the saddle. The stirrup support strap is looped around a lower span portion of the D-ring associated therewith and has a width that is essentially the same as the length of the lower span portion of the D-ring. This prevents sliding movement of the strap, relative to the D-ring, in a direction lengthwise of the horse on which the saddle is mounted. The stirrup straps are designed to hang straight down at a 90 degree angle with respect to the saddle.

Applicant has found that in some instances it is more comfortable for the rider when the stirrup support strap is allowed to move a limited amount relative to the D-ring. As an example some pleasure riders may have limited knee flexibility making it difficult for them to use the stirrup to mount the horse and/or use the stirrups while riding. Riders with leg problems can no longer flex their knees properly for the appropriate upright riding stance.

SUMMARY OF INVENTION

In keeping with the foregoing there is provided in accordance with one aspect of the present invention an improved D-ring for supporting a stirrup by a strap looped around and depending downwardly from a lower span of the D-ring, said D-ring lower span having an upper stirrup strap engaging surface that comprises first and second contiguous elongate portions with an aggregate length that is a predetermined amount greater than the width of the stirrup strap associated therewith.

A modified saddle D-ring having a loop of a varying radius for supporting a stirrup strap on a saddle. The stirrup supporting strap is looped around a lower span portion of the D-ring which has an upper span portion anchored to the saddle. The lower span has an upper surface that abuts against the saddle supporting strap and such upper surface includes first and second contiguous portions disposed at a preselected angle to one another with the length being greater than the width of the stirrup supporting strap. The D-ring includes an elongated curved loop extending forward at a varying radius depicting a parabolic curve. The elongated D-ring allows limited pivotal forward movement of the stirrup with respect to the saddle. One or more D-Ring strap positioning members comprising "T" shaped projections extend upward from one a selected position at the bottom of the D-ring for adjusting and holding the D-ring in position.

The D-ring strap positioning member comprises a projection extending upward from selected portions of the D-ring defining a leg so that the edge of the strap abuts the edge of the leg limiting forward or rearward movement of the stirrup strap on the D-ring. The leg includes a retaining means defining a keeper such as an enlargement or knob, a top flange, a lip or cross member, extending normal to the leg to restrict forward or rearward movement and aid in removable holding the strap in the selected position resisting lateral movement of the strap and preventing the strap from riding over the D-ring strap positioning member.

A modified saddle D-ring having a loop of a varying radius for supporting a stirrup strap on a saddle and a modified saddle incorporating the same. Each stirrup supporting strap of the saddle is looped around a lower span portion of an elongated D-ring. The elongated D-ring has a length greater than the width of the stirrup supporting strap. The curved bottom portion of the elongated D-ring comprises an elongated wire or rod forming a generally "D" shaped loop oriented having a top straight portion of the "D" forming a top portion of the loop and having a generally rectangular rear end portion. In the improved D-ring, the rear end portion of the D-ring curves downward at a right angle with respect to the top straight portion a selected distance forming a straight rear leg portion before curving forward inwardly and in-under the top straight portion of the loop. From about the mid-point of the bottom portion of the loop, the loop extends forward at a varying radius depicting a parabolic curve extending from about the midpoint of the bottom of the loop gradually curving toward the front end of the elongated loop whereby the loop curves forming a right angle with the top horizontal straight portion of the loop. The modified elongated D-ring allows limited pivotal forward movement of the stirrup with respect to the saddle and is designed to give added comfort to the horse, greater safety, stability, and control to the rider. The D-ring strap positioning members defining a projection in the shape of a "T" extends upward from one or more selected positions along the bottom of the D-ring providing a means for adjusting and holding the D-ring and orientation of the strap.

There is provided in accordance with another aspect of the present invention a saddle having a pair of stirrups suspended therefrom by a respective one of a pair of straps, each said stirrup supporting strap being looped around a lower span portion of a D-ring that has an upper span portion anchored to the saddle, said lower span portion of said D-ring having an upper surface that abuts against the saddle supporting strap associated therewith and wherein such upper surface comprises first and second contiguous portions disposed at a preselected angle to one another and wherein the length of each of said first and second portions are correlated in a predetermined manner to the width of the stirrup strap associated therewith.

A principal object of the present invention is to provide a saddle with D-rings for the stirrup support straps that allow the stirrup to swing forward a selected amount.

A further object of the present invention is to provide a modified D-ring for a saddle wherein the ratio of the length of the stirrup strap engaging portion of the D-ring to the width of the strap associated therewith is a selected amount greater than one.

A further object of the present invention is to provide a D-ring that supports a stirrup support strap on a saddle in which the strap engaging portion on the D-ring has contiguous first and second portions with an aggregate length a preselected amount greater than the width of the stirrup supporting strap associated therewith.

A still further object of the present invention is to provide a D-ring that supports a stirrup support strap on a saddle in which the strap engaging portion on the D-ring has contiguous first and second portions with an aggregate length a preselected amount greater than the width of the stirrup supporting strap associated therewith and wherein said first portion is substantially linear and said second portion angularly related to said first portion.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the several views and wherein:

FIG. 7 is a perspective view of the underside of the flexible tree saddle shown in FIGS. 1-3 showing the attachment points of the straps to the pummel in the front and cantle in the rear with no bars or other rigid structures connecting same;

FIG. 8 is a perspective rear view of a flexible tree type saddle such as is shown in FIG. 1, showing an upper layer of leather and bottom layer of wool;

DETAILED DESCRIPTION OF THE PREFERRED EMBODIMENT

Figure 1:
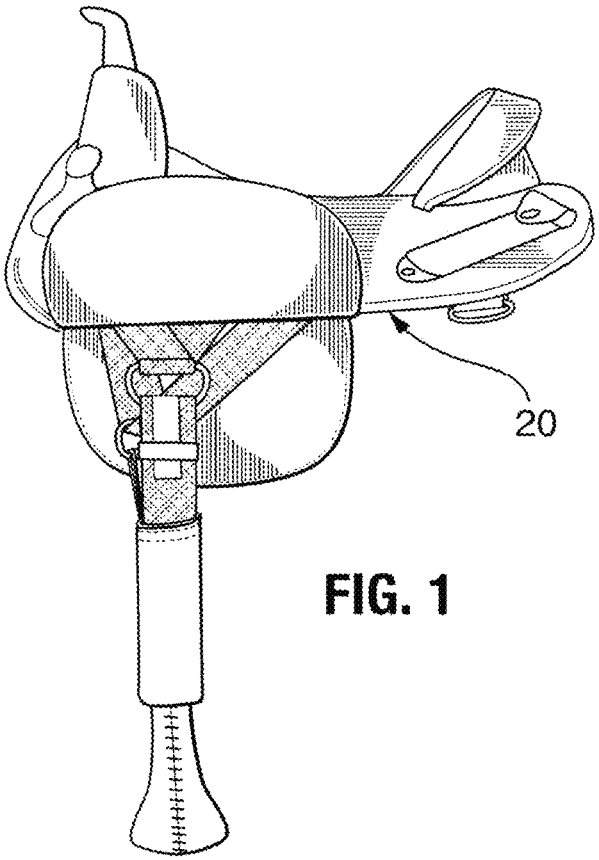
FIG. 1 is a side elevational view of a saddle provided in accordance with one embodiment of the present invention wherein the elongated D-ring supports a stirrup showing the elongated D-ring and stirrup strap lying over a cinch strap with a conventional D-ring.
Figure 2:
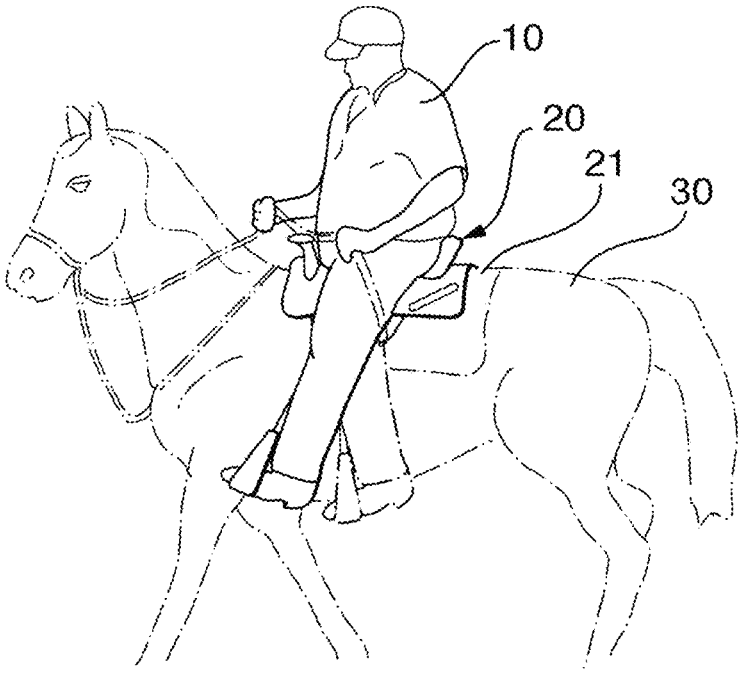
FIG. 2 is a side view illustrating a horse rider with an outstretched leg that requires the stirrup strap to pivot on the elongated D-ring allowing the stirrup to move forwardly of a position for a normal upright riding stance.

Illustrated in FIG. 1, is a rider 10 sitting on a saddle 20 mounted on the back of a horse 30. The saddle 20 as shown in the drawings is a western style saddle and more particularly known by Applicants' tradename as a TREELESS saddle in that the saddle tree comprises a two piece independent bar less system as described in U.S. Pat. Nos. 5,187,924 and 5,018,340 hereby incorporated by reference in its entirety. Conventional English and western saddles utilize a tree have a pair of longitudinal members such as a pair of bars 68 connect the pommel 170 which may support a saddle horn 76, and the cantle 171. The pommel and the cantle are made of solid material such as wood, fibreglass, or combinations thereof. The flexible tree or TREELESS saddle shown in FIGS. 1-3 only uses the cantle and pommel parts of the tree flexibly connected together. The independent pommel/cantle two-piece system or TREELESS saddle lets the horse flex and move freely while letting the rider keep complete contact with the horse. The top surface of the saddle including the seat 77 is finished in leather 72. The centre layer of the saddle comprises two layers 91, 92 of closed cell neoprene into which is bonded to the stirrup and cinch rigging webbing distal ends 93 which are positioned beneath and affixed to the pommel or cantle by screws, nails, adhesives and combination thereof. On the bottom of the saddle a poly-wool fleece cover 94 is stitched below the neoprene 91, 92. The rider sits softly and in closer contrast to the horse, which places the centre of gravity lower compared to a conventional western saddle where the one-piece tree remains rigid and does not flex with the horse whereby the bars 68 can dig into the horses's shoulder on the hard turns and the rider sits one to two inches off the horse's back raising the centre of gravity. Removal and replacement of the rigid bars 68 with a flexible support assembly provides for independent movement of the pommel tree 70 apart from the cantle tree 71 resulting in a softer seat, flexible action and no framework to poke or pressure the horse. The flexible saddle tree utilizes a secure western girthing system like the traditional western saddles typically using stirrup and cinch rigging with a front or front and rear D-rings and a crupper for utility on the trails.

One preferred embodiment of the flexible saddle tree shown in FIGS. 1-3, and 7-8 is made using five layers of material. The first top outer layer is select leather 72 as shown best in FIG. 8. The saddle skirt 74 made up of two layers of closed cell neoprene around which the rest of the saddle is built, the outer top layer of closed-cell neoprene rubber and inside layer or patches of neoprene rubber. Attached to the layer of the neoprene layer 91 at selected positions is an inside layer of closed-cell neoprene rubber 92. A strong nylon webbing stirrup 14 and cinch webbing 26 rigging forms webbing layer 93 for securing stirrup strap 14 and girth or cinch riggings 26 is permanently bonded between the neoprene layer 91 and 92, and the bottom surface of the cantle and pommel. The webbing layer 93 covered by another layer of neoprene rubber 92 so that it is disposed between an inner layer of closed-cell neoprene rubber 91 and a second outer layer of closed-cell neoprene rubber 92 which either covers the underside of the saddle or selected portions of the underside of the saddle 22 as patches of material. This durable rubber is used, for instance, to cover industrial pipes and in the construction of scuba diver suits. The bottom layer next to the horse is a natural or poly wool fleece 94. After construction of the saddle body, the leather is attached to the top surface of the saddle skirt 74 and to the fleece layer on the bottom of the saddle by stitching, adhesives, rivets, and combinations thereof. The saddle of the present invention places no more pressure on the horses spine as there would be riding bareback.

The two part flexible tree eliminates the usage of heavy wooden bars extending between the forks and the cantle of the saddle trees of conventional saddles through the use of a lightweight underlayment, thereby providing flexibility and balance for the rider. The arrangement includes nylon straps, stitched onto the underlayment and secured to the forks and cantle, which serve as stirrup and girth straps. The sports saddle of the invention is light in weight, affords better contact with the body of the horse, representing manufacturing/assembly advantages and, importantly, permits the "floating" of the saddle trees.

The flexible saddle tree construction designs allow the flexible saddle tree to be lightweight, as little as 11 to 20 pounds. The pommel and cantle are formed from solid materials. They can be called tree parts, but these parts are not produced as a result of cutting a saddle tree in half. Instead, either wood or plastic is used and fashioned precisely to provide a flat area, approximately 4 inches in diameter, where the pommel or cantle is attached to the skirt. Thus, there are no pressure points created. The solid pommel and cantle provide a secure seat, yet the seat materials provide a cushy, durable area that conforms to and comforts the horse's back. The stirrups can be ordered either for western or endurance riding, so that the center of gravity is either forward or more underneath the rider for posting. No more sore seat bones as the rider sits between the pommel and cantle on two layers of closed cell neoprene. The top of the saddle is covered in selected leather and the underside in traditional fleece.

The rigging is set securely between the neoprene layers to distribute the riders balance and weight for the riding style. This combination provides the fit and feel of bareback riding but with the actual function of a saddle. The rigging is bonded into the skirt in the form of a fan, spread out between pommel and cantle so that pressure from stirrups and girth are distributed across the skirt into a large area across the whole saddle. This design eliminates pressure points and relieves the horse from pain and discomfort. Riders have reported that they can actually sense when their horse is getting ready to crow-hop or spook.

Figure 3:
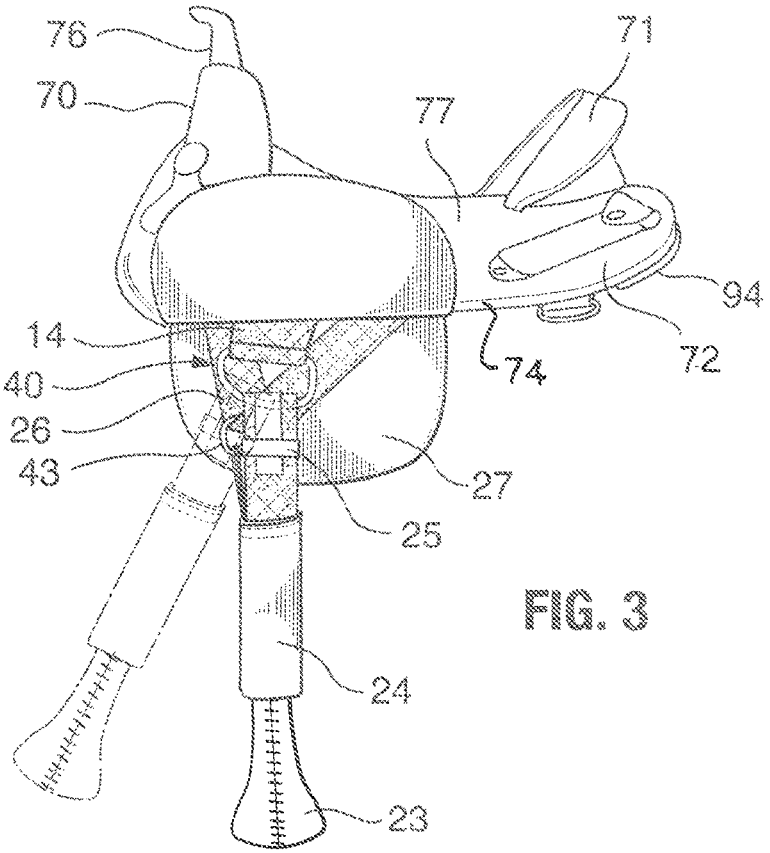
FIG. 3 is a perspective view of the saddle of FIG. 1 without the rider showing the stirrup strap pivoting on the elongated D-ring allowing the stirrup to move forwardly of a position for a normal upright riding stance.

As illustrated best in FIGS. 1 and 3, the TREELESS saddle is placed on a pad or blanket 21. A pair of stirrups 23 with one being located on each of opposite sides of the horse extends from the saddle with the stirrup on one side only seen in full in the side views illustrated and it is to be understood the other one of the pair on the other side is a mirror image of the one shown.

Extending from the stirrup webbing or strap 14 is a D-ring 40 moveably suspending stirrup strap 24 which supports the stirrup 23 suspended from a D-ring 40 by a stirrup strap 24 that conventionally is adjustably variable in length by adjustable holding means 25 which may comprise a belt and buckle arrangement, knotted strip of leather or cord, or sewn loop.

The D-ring 40 is the same whether it be one side or the other of the saddle and since the present invention is directed solely to modifications to the D-ring 40 a detailed illustration of the two stirrups and suspension thereof from the saddle by a respective one of a pair of the D-rings is deemed unnecessary.

Conventionally the D-ring 40 is anchored to the saddle by a strap 14 that has the opposite ends thereof attached to the saddle at respective positions spaced apart from one another. The saddle 22 include a flexible flap or fender 27 attached thereto which is shown flipped up in FIGS. 1 and 3 exposing the cinch strap D-ring 43 supporting the cinch strap 26 and stirrup strap D-ring 40 supporting a stirrup strap 24. The flap 27 normally depends downwardly to overlie and cover the D-rings and straps 14, 26 associated therewith except for the lower portion of the stirrup strap 24 that extends downwardly to the stirrup 23.

The elongated saddle stirrup D-ring 40 comprises, consists essentially of, and consists of a loop of a varying radius for supporting a stirrup strap 24 from a saddle 22. Each stirrup supporting strap 24 of the saddle 22 is looped around a lower span portion of an elongated D-ring 40. The elongated D-ring 40 has a length greater than the width of the stirrup supporting strap 24. The curved bottom portion 50 of the elongated D-ring 40 comprises an elongated wire or rod forming a generally "D" shaped loop oriented having a top straight portion 51 of the "D" forming a top portion of the loop and having a generally rectangular rear end portion 52. In the improved D-ring, the rear end portion 52 of the D-ring 40 curves downward at a right angle with respect to the top straight portion 51 a selected distance forming a straight rear leg portion 53 before curving forward inwardly and in-under the top straight portion of the loop forming a rear curved portion 54. From about the mid-point of the bottom portion of the curved loop, the curved loops extends forward at a varying radius depicting a parabolic curve portion 57 extending from about the midpoint 55 of the bottom of the loop gradually curving toward the front end 59 of the elongated loop whereby the loop curves forming a generally right angle portion 56 with the top horizontal straight portion 51 of the loop. The modified elongated D-ring 40 allows limited pivotal forward movement of the stirrup 23 with respect to the saddle 22.

The elongated saddle stirrup D-ring 40 incorporating the D-ring strap positioning member comprises, consists essentially of, and/or consists of a loop of a varying radius for supporting a stirrup strap 24 from a saddle 22. Each stirrup supporting strap 24 of the saddle 22 is looped around a lower span portion of an elongated D-ring 40. The elongated D-ring 40 has a length greater than the width of the stirrup supporting strap 24. The curved bottom portion 50 of the elongated D-ring 40 comprises an elongated wire or rod forming a generally "D" shaped loop oriented having a top straight portion 51 of the "D" forming a top portion of the loop and having a generally rectangular rear end portion 52. In the improved D-ring, the rear end portion 52 of the D-ring 40 curves downward at a right angle with respect to the top straight portion 51 a selected distance forming a straight rear leg portion 53 before curving forward inwardly and in-under the top straight portion of the loop forming a rear curved portion 54. From about the mid-point of the bottom portion of the curved loop, the curved loops extends forward at a varying radius depicting a parabolic curve portion 57 extending from about the midpoint 55 of the bottom of the loop gradually curving toward the front end 59 of the elongated loop whereby the loop curves forming a generally right angle portion 56 with the top horizontal straight portion 51 of the loop. The modified elongated D-ring 40 allows limited pivotal forward movement of the stirrup 23 with respect to the saddle 22.

The portion of the D-ring comprising the lower span 41 has an upper surface that engages the stirrup support strap 24. In accordance with the present invention the length of that upper surface is greater than the width of the stirrup supporting strap associated therewith. The curved portions allows the strap 24 to swing forwardly and rearwardly as the rider shifts their weight.

Figure 13:
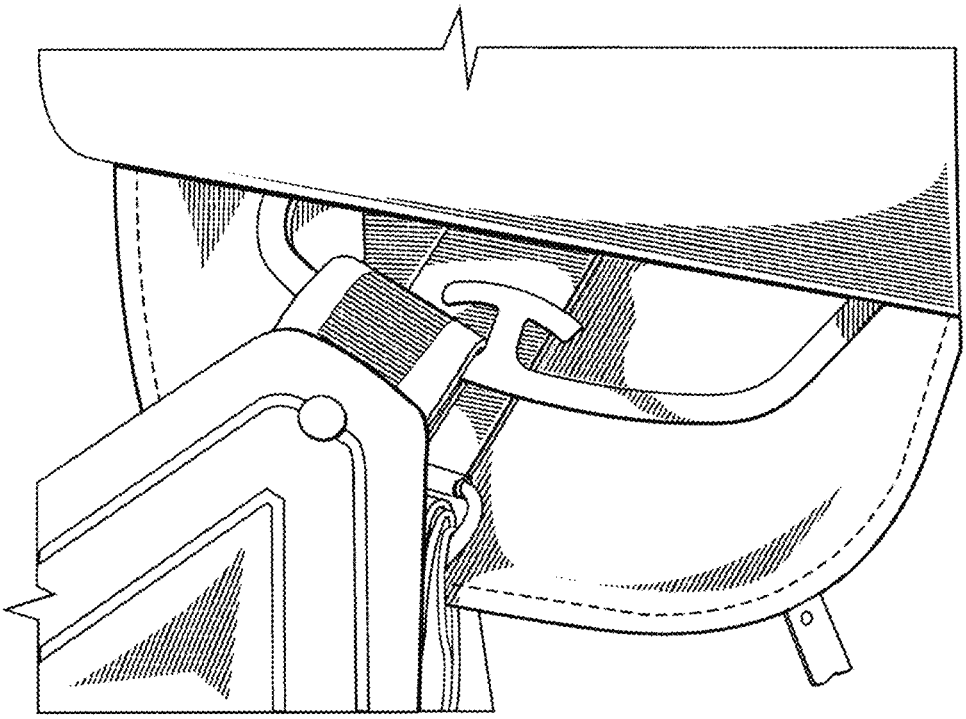
FIG. 13 shows a stirrup strap extending from the D-ring.
Figure 14:
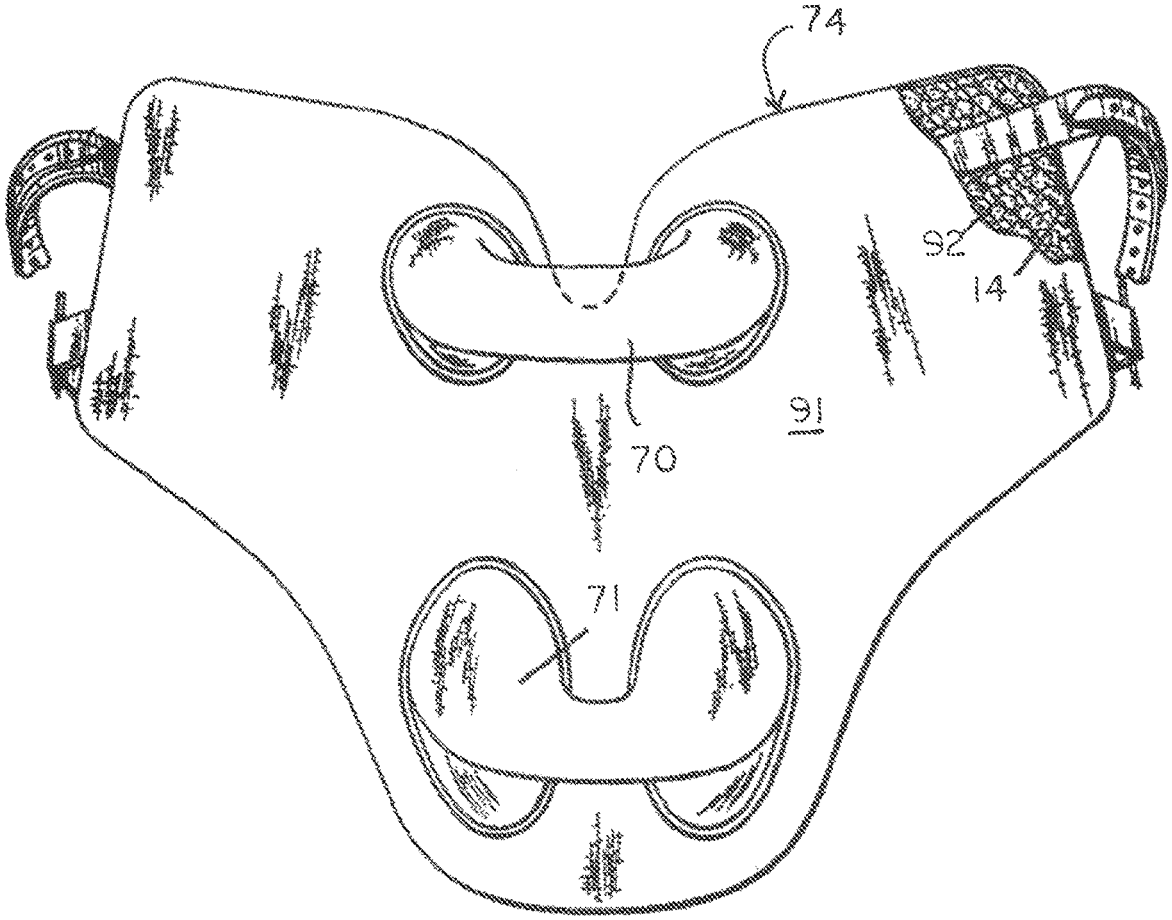
FIG. 14 is a top view of FIG. 7, showing the front pommel tree, rear cantle tree, and strap disposed between the inner neoprene layer and outer neoprene layer of the saddle skirt.

The D-ring strap positioning member 90 comprises a projection extending upward from selected portions of the D-ring defining a leg 61 so that the edge of the strap abuts the edge of the leg 61 limiting forward or rearward movement of the stirrup strap on the D-ring. As shown in FIGS. 9 and 11-13, the leg 61 includes a retaining means defining a keeper 62 defining an enlargement such as a knob 63, a top flange or lip 64 or cross member 95 extending normal to the leg 61 to restrict forward or rearward movement and aid in removable holding the strap in the selected position resisting lateral movement of the strap and preventing the strap from riding over the D-ring strap positioning member. The cross member or lip may be curved downward to further hold the strap in position as shown in FIG. 13.

Figure 4:
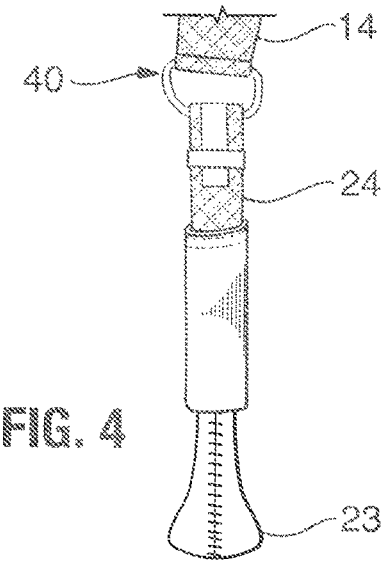
FIG. 4 is a side elevational view of the elongated D-ring, stirrup and stirrup support strap of the saddle shown in FIG. 4.
Figure 5:
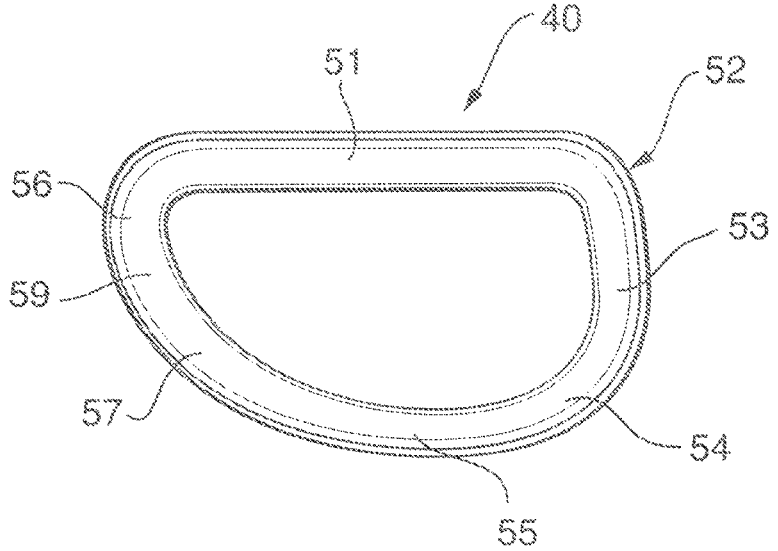
FIG. 5 is a side elevational view of a conventional D-ring.
Figure 6:
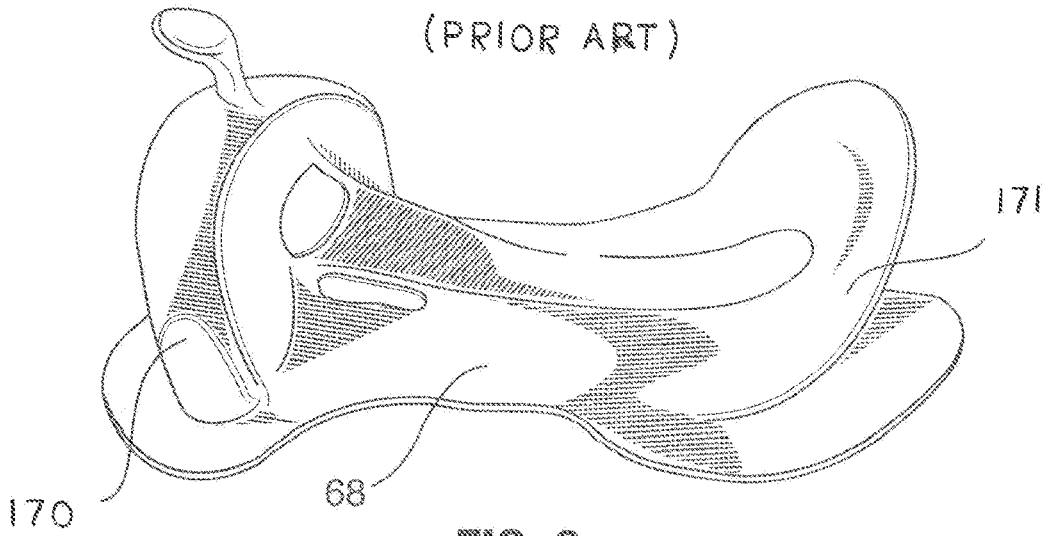
FIG. 6 is a perspective view of a conventional saddle tree including a pommel, cantle, and wooden bars extending therebetween.
Figure 9:
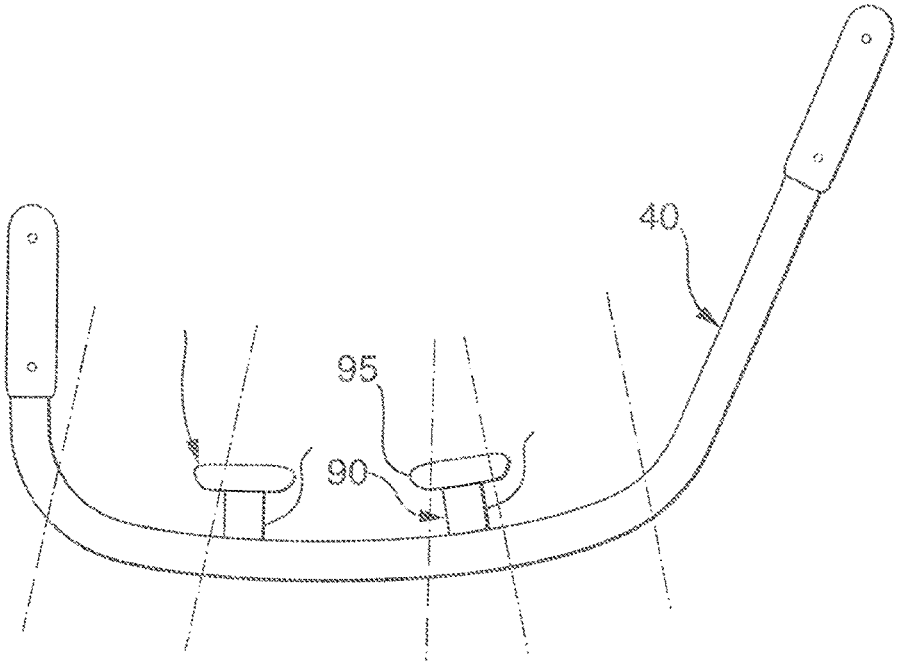
FIG. 9 shows a triple position rigging utilizing a D-ring with a pair of spaced apart D-ring strap positioning members positionable for a forward position, a center barrel racing position, and a rear endurance position.
Figure 10:
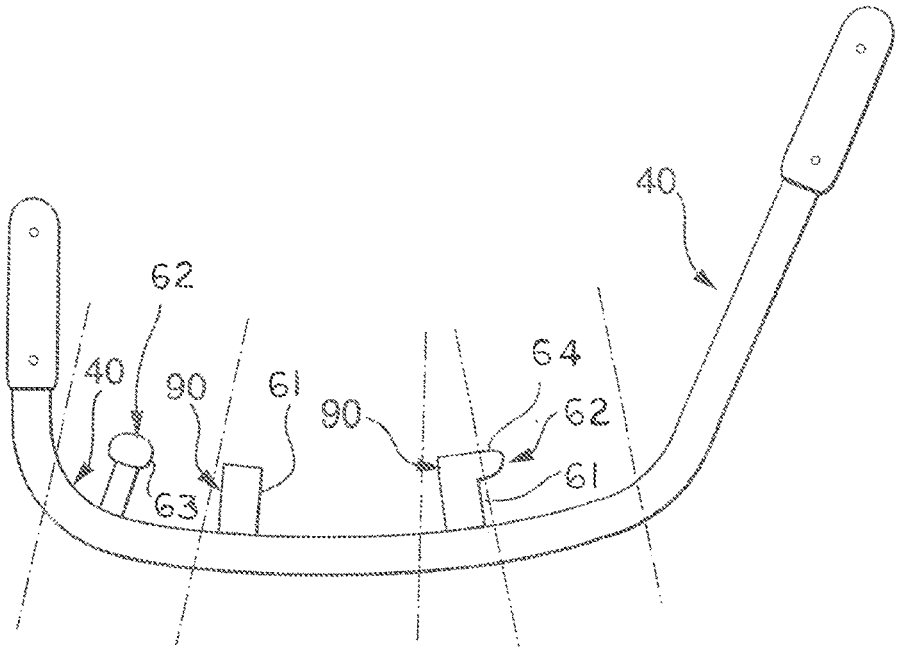
FIG. 10 shows a triple position rigging utilizing a D-ring with a pair of spaced apart D-ring strap positioning members positionable for a forward position, a center barrel racing position, and a rear endurance position.
Figure 11:
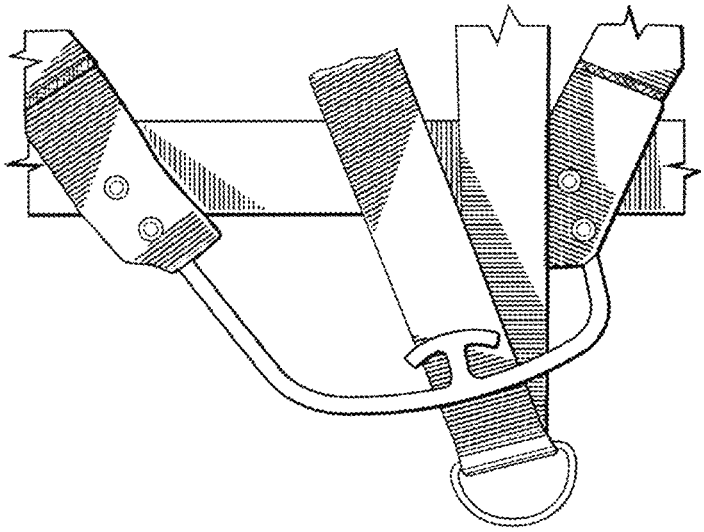
FIG. 11 shows a D-ring and straps together with a D-ring positioning member providing for forward and rear positions.
Figure 12:
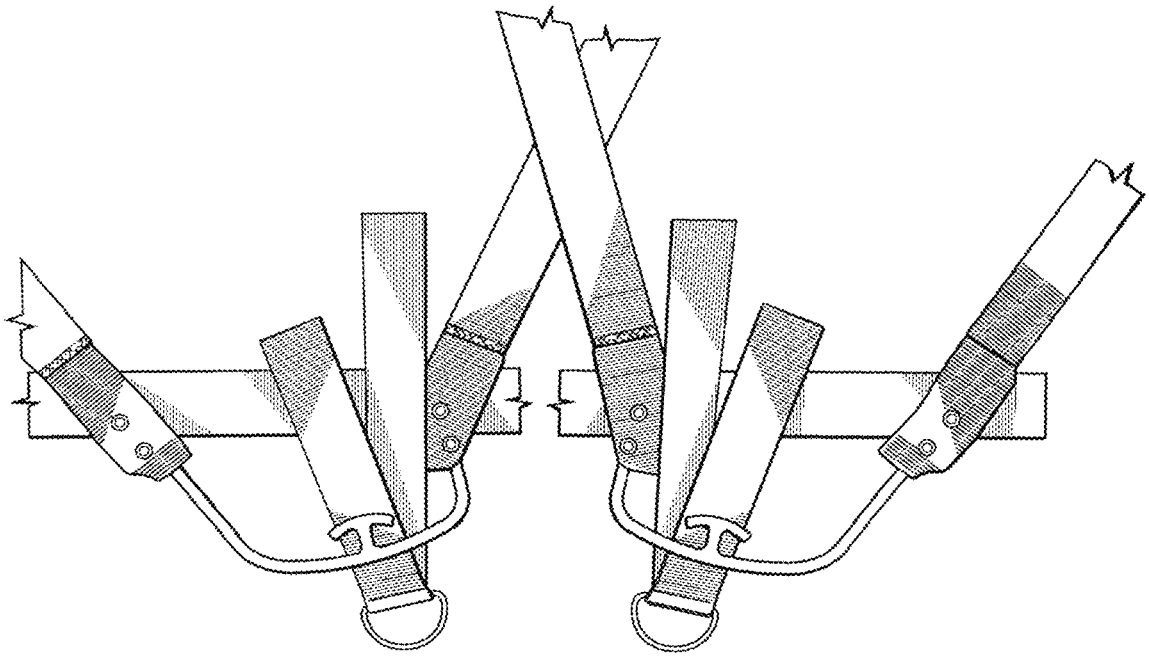
FIG. 12 shows a pair of D-ring positioning member providing for forward and rear positions.

In the embodiment illustrated in FIGS. 3 and 4 the stirrup strap engaging upper surface comprises first and second contiguous elongate portions 45, 46 that are angularly related relative to one another.

In each embodiment the ratio of the aggregate length of stirrup strap engaging portions on the D-ring to the width of the stirrup support strap associated therewith is a preselected amount greater than one and up to double the strap width. In the embodiment of FIGS. 3 and 4 the transition from one portion to the other provides some resistance to sliding of the support strap from one to the other of the contiguous portions 45, 46. The two different positions are representatively illustrated in FIG. 2 by the riders two different leg positions. Each of the portions 45 and 46 may for example be the same length as the width of the stirrup strap.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

I claim:

1. A saddle having an adjustable stirrup strap assembly, comprising:

a top outer layer comprising leather covering a saddle skirt comprising an underlayment having a first layer of cellular neoprene or rubber and a second layer of cellular neoprene or rubber adherring to said first layer of neoprene layer at selected positions;

a front tree comprising a pommel having a left pommel base and a right pommel base and rear tree comprising a cantle having a left cantle base and a right cantle base;

said front tree and said rear tree flexibly connecting together and spaced apart from one another having a bottom portion of said left ponnel base and said right pommel base and a bottom portion of said left cantle base and said right cantle base attaching to a top surface of said first layer of said cellular neoprene or rubber;

a first stirrup strap webbing and a first end of a first girth strap webbing is bonded to a bottom surface of said first layer of said cellular neoprene or rubber beneath said left pommel base and a second end of said first girth strap webbing is bonded to a bottom surface of said first layer of said cellular neoprene or rubber beneath said left cantle base;

a second stirrup strap webbing and a first end of a second girth strap webbing is bonded to a bottom surface of said first layer of said cellular neoprene or rubber beneath said right pommel base and a second end of said second girth strap webbing is bonded to a bottom surface of said first layer of said cellular neoprene or rubber beneath said right cantle base;

said second layer of cellular neoprene or rubber covering and adhering to said bottom portion of said left ponnel base and said right pommel base and a bottom portion of said left cantle base and sad right cantle base, said first stirrup strap webbing and said second stirrup strap webbing, said first end of a said first girth strap webbing beneath said left pommel base and said second end of said first girth strap webbing beneath said left cantle base, said first end of said second girth strap webbing beneath said right pommel base and said second end of said second girth strap webbing beneath said right cantle base, and to a bottom surface of said first layer of said cellular neoprene or rubber;

the improvement comprising:

a pair of stirrups each one suspended by a stirrup strap, each one extending from an elongated D-ring extending from the corresponding stirrup strap webbing, said elongated D-ring having a length that is a selected amount greater than the width of said stirrup strap whereby said stirrup strap pivotally swings through a predetermined arc; and at least two D-ring strap positioning members defining projections extending upward from a selected position of a curved bottom portion of said elongated D-ring, said D-ring strap positioning members limiting forward or rearward movement of said stirrup strap on said elongated D-ring for a forward position, a center barrel racing position, and a rear endurance position.

2. The saddle having an adjustable stirrup strap assembly of claim 1, wherein said positioning member is selected from the group consisting of at least one knob, at least one flange, at least one cross member, and combinations thereof extending normal to said leg for restricting forward or rearward movement of said stirrup strap.

3. A saddle having an adjustable stirrup strap assembly, consisting of:

a top outer layer comprising leather covering a saddle skirt comprising an underlayment having a first layer of cellular neoprene or rubber and a second layer of cellular neoprene or rubber adherring to said first layer of neoprene layer at selected positions;

a front tree comprising a pommel having a left pommel base and a right pommel base and rear tree comprising a cantle having a left cantle base and a right cantle base;

said front tree and said rear tree flexibly connecting together and spaced apart from one another having a bottom portion of said left ponnel base and said right pommel base and a bottom portion of said left cantle base and said right cantle base attaching to a top surface of said first layer of said cellular neoprene or rubber;

a first stirrup strap webbing and a first end of a first girth strap webbing is bonded to a bottom surface of said first layer of said cellular neoprene or rubber beneath said left pommel base and a second end of said first girth strap webbing is bonded to a bottom surface of said first layer of said cellular neoprene or rubber beneath said left cantle base;

a second stirrup strap webbing and a first end of a second girth strap webbing is bonded to a bottom surface of said first layer of said cellular neoprene or rubber beneath said right pommel base and a second end of said second girth strap webbing is bonded to a bottom surface of said first layer of said cellular neoprene or rubber beneath said right cantle base;

said second layer of cellular neoprene or rubber covering and adhering to said bottom portion of said left ponnel base and said right pommel base and a bottom portion of said left cantle base and said right cantle base, said first stirrup strap webbing and said second stirrup strap webbing, said first end of said first girth strap webbing beneath said left pommel base and said second end of said first girth strap webbing beneath said left cantle base, said first end of said second girth strap webbing beneath said right pommel base and said second end of said second girth strap webbing beneath said right cantle base, and to a bottom surface of said first layer of said cellular neoprene or rubber;

the improvement consisting of:

a pair of stirrups each one suspended by a stirrup strap, each one extending from an elongated D-ring extending from the corresponding stirrup strap webbing;

said elongated D-ring having a length that is a selected amount greater than the width of said stirrup strap whereby said stirrup strap pivotally swings through a predetermined arc;

and at least two D-ring strap positioning members defining projections extending upward from a selected position of a curved bottom portion of said elongated D-ring, said D-ring strap positioning members limiting forward or rearward movement of said stirrup strap on said elongated D-ring for a forward position, a center barrel racing position, and a rear endurance position.

4. The saddle having an adjustable stirrup strap assembly of claim 3, wherein said positioning member is selected from the group consisting of at least one knob, at least one flange, at least one cross member, and combinations thereof extending normal to said leg for restricting forward or rearward movement of said stirrup strap and holding said strap in a selected position.

5. A saddle having an adjustable stirrup strap assembly, consisting of:

a top outer layer comprising leather covering a saddle skirt comprising an underlayment having a first layer of cellular neoprene or rubber and a second layer of cellular neoprene or rubber adherring to said first layer of neoprene layer at selected positions;

a front tree comprising a pommel having a left pommel base and a right pommel base and rear tree comprising a cantle having a left cantle base and a right cantle base;

said front tree and said rear tree flexibly connecting together and spaced apart from one another having a bottom portion of said left ponnel base and said right pommel base and a bottom portion of said left cantle base and said right cantle base attaching to a top surface of said first layer of said cellular neoprene or rubber;

a first stirrup strap webbing and a first end of a first girth strap webbing is bonded to a bottom surface of said first layer of said cellular neoprene or rubber beneath said left pommel base and a second end of said first girth strap webbing is bonded to a bottom surface of said first layer of said cellular neoprene or rubber beneath said left cantle base;

a second stirrup strap webbing and a first end of a second girth strap webbing is bonded to a bottom surface of said first layer of said cellular neoprene or rubber beneath said right pommel base and a second end of said second girth strap webbing is bonded to a bottom surface of said first layer of said cellular neoprene or rubber beneath said right cantle base;

said second layer of cellular neoprene or rubber covering and adhering to said bottom portion of said left ponnel base and said right pommel base and a bottom portion of said left cantle base and sad right cantle base, said first stirrup strap webbing and said second stirrup strap webbing, said first end of a said first girth strap webbing beneath said left pommel base and said second end of said first girth strap webbing beneath said left cantle base, said first end of said second girth strap webbing beneath said right pommel base and said second end of said second girth strap webbing beneath said right cantle base, and to a bottom surface of said first layer of said cellular neoprene or rubber;

the improvement consisting of:

a stirrup strap rigging assembly including a pair of stirrups each one suspended by said stirrup strap, each one extending from an elongated D-ring extending therefrom from the corresponding stirrup strap webbing;

said elongated D-ring having a length that is a selected amount greater than the width of said stirrup strap whereby said stirrup strap pivots to swing through a predetermined arc;

and at least one D-ring strap positioning member extending upward from a selected position of a curved bottom portion of said elongated D-ring, said D-ring strap positioning member limiting forward or rearward movement of said stirrup strap on said elongated D-ring positioning member for a forward position and a rear position.

* * * * *